United States Patent [19]

Büdenbender

[11] Patent Number: 4,934,551

[45] Date of Patent: Jun. 19, 1990

[54] COVER FOR A BUNG-TYPE BARREL OR DRUM

[76] Inventor: Bernd Büdenbender, Schubertweg 5, 2160 Stade, Fed. Rep. of Germany

[21] Appl. No.: 240,315

[22] Filed: Sep. 2, 1988

[30] Foreign Application Priority Data

Sep. 7, 1987 [DE] Fed. Rep. of Germany ... 8712115[U]
Mar. 9, 1988 [DE] Fed. Rep. of Germany ... 8803185[U]
Aug. 8, 1988 [DE] Fed. Rep. of Germany ..... 3826906

[51] Int. Cl.[5] ..... B65D 8/02

[52] U.S. Cl. ..... 220/66; 220/5 R; 220/DIG. 6

[58] Field of Search ..... 220/5 R, 5 A, 66, 465, 220/466, DIG. 1, DIG. 6

[56] References Cited

U.S. PATENT DOCUMENTS

| | | | |
|---|---|---|---|
| 943,686 | 12/1909 | Kruse | 220/66 X |
| 943,687 | 12/1909 | Kruse | 220/DIG. 1 X |
| 1,413,907 | 4/1922 | Gerstenberger | 220/DIG. 6 X |
| 2,058,665 | 10/1936 | Coakley | 220/466 X |
| 2,127,269 | 8/1938 | Robinson | 220/465 X |
| 2,445,730 | 7/1948 | Kuhn | 220/5 R |
| 3,170,586 | 2/1965 | Bulgrin | 220/5 R |
| 3,339,793 | 9/1967 | Gerlovich | 220/66 |
| 3,722,732 | 3/1973 | Edlund | 220/66 |
| 4,767,021 | 8/1988 | Pies | 220/66 X |

FOREIGN PATENT DOCUMENTS

| | | | |
|---|---|---|---|
| 733200 | 3/1943 | Fed. Rep. of Germany . | |
| 802327 | 2/1951 | Fed. Rep. of Germany | 220/66 |
| 3546458 | 10/1986 | Fed. Rep. of Germany . | |
| 3600532 | 10/1986 | Fed. Rep. of Germany . | |
| 3706581 | 7/1988 | Fed. Rep. of Germany . | |

*Primary Examiner*—Gerald A. Michalsky
*Attorney, Agent, or Firm*—Herbert Dubno

[57] ABSTRACT

A drum cover has a short wall portion received in the drum and connected at its outer edge to an edge of the drum body. The cover is provided with two openings or lands which are thrust out of the plane of the cover disk, the lands annularly surrounding the filling openings and lying in planes normal to the drum axis to facilitate connection of pipe stubs or the like thereto, e.g. by welding.

20 Claims, 4 Drawing Sheets

COVER FOR A BUNG-TYPE BARREL OR DRUM

FIELD OF THE INVENTION

My present invention relates to a cover for use in making a bung-type container such as a barrel or drum having a generally cylindrical drum body whose upper and lower ends are closed respectively by the cover and a bottom snugly and firmly fixed to the body.

BACKGROUND OF THE INVENTION

It is known to provide barrels or drums with cover and bottom members which are peripherally secured to the generally cylindrical drum body and in which at least the cover member is formed with a filling opening, an edge of which can be secured to a fitting of a tap or other closure member adapted to be used in draining or filling the drum. The cover disk can be recessed in the upper end of the drum body and the cover can be formed with a short wall portion surrounding the cover disk which is formed with the opening along the upper edge of the wall portion, the cover is secured to the upper edge of the generally cylindrical body by mechanical means, such as folding or rolling and/or by a weld seam.

In the past, the cover disk of the cover was generally planar. Such covers had the drawback that they were easily deformable, can be plastically distorted with even relatively small forces applied from the exterior and could not necessarily allow the contents of the barrel or drum to drain fully.

To overcome the tendency of a flat or planar cover disk to deform with only slight applied forces, it has been proposed for small containers such as food cans or containers for lacquers or paints, to form the cover disk or the bottom disk with circular corrugations or limited depth by an embossing process to stabilize these surfaces structurally.

For large containers, especially drums or barrels, covers with slightly convex dished disk configurations were employed to increase the resistance to deformation.

With such systems, it was found to be difficult to weld flanges, pipe fittings or the like with closures such as bungs or taps because it could not be assured that the applied fitting would always be perpendicular to the surface region in which the fitting was attached.

Indeed, with dished or domed covers provided with bungs or plugs, generally where two such plugs were provided on opposite sides of the cover, they had mutually divergent axes.

As noted, the complete emptying of barrels or drums has long been a problem. When, for example, a suction pipe connection to a pump is used, a substantial residue within the barrel could not be avoided. It has been found, in practice, that one could not even remove these residues completely by turning over a barrel and draining it from the filling opening in most cases.

In German Patent Document DE-OS No. 37 06 581, it is suggested that conventional plugs or tape applied by force-fit, welding or a screw connection not be used, but rather the barrel be provided with a fitting having a length equal to the thickness of the sheetmetal of the cover and securing it in the filling opening by the use of a laser weld seam. The tap is then applied to this element. The fitting in this case, does not project materially into the interior of the container, but rather lies flush with the inner surface thereof, by contrast with other fitting systems which project significantly into the interior of the drum, thereby allowing a relatively complete draining when the drum has been turned over.

OBJECT OF THE INVENTION

It is the principal object of the present invention to provide a drum of the type described and especially a cover for such a drum which has an improved construction and can be fabricated with a minimum of additional cost, such that the drum equipped with such a cover can be practically completely drained, that taps, cocks or like closures or fittings can be applied at an economical and efficient manner and so that upon the application of such fittings, there is no need for them to project into the interior of the container equipped with the cover.

SUMMARY OF THE INVENTION

This object and others which will become apparent hereinafter are attained, in accordance with the present invention, in a bung-type drum having a generally cylindrical body and a bottom closing a lower end and a top cover closing the upper end.

The terms "top" and "bottom" are used herein for convenience to describe the cover and assume an upright barrel or drum. It will be understood, of course, that the description while providing for an upright drum with the member having the filling openings deemed to be the cover member, although the description in the claims are appropriate as well to the barrel or drum regardless of its orientation.

According to the invention, the cover fitting into the upper end of the body has a small wall portion lying along an inner surface of the body and has a rim secured to the body at the upper end thereof, e.g. by a weld seam and/or by other mechanical means, such as the folding over or rolling over of edges of the body and the short wall portion.

According to the invention, the cover disk is provided with two filling openings and each of these filling openings is formed in a generally flat land and is sworn by an annular zone of the land lying in a plane perpendicular to the axis of the drum. Each of the lands, moreover, is thrust out of a median plane of the cover disk normal to this axis and at least one of these lands with at least one of the openings formed therein projects above a remainder of the cover disk.

By having the lands which are provided with the filling opening thrust out of the cover disk, I can ensure that each of these lands lies in a plane which is normal to, i.e. perpendicular to, the vertical axis of the cover.

This facilitates not only the welding of fittings to margins or edges of the openings which do not project into the interior of the drum, i.e. inwardly, beyond the inner surface of the cover desk, but also extend vertically or parallel to the axis.

Furthermore, the upwardly lying one of these lands can form a draining funnel which, when the drum is inverted, forms a downward point from which the contents of the drum can be practically fully drained.

According to a feature of the invention, the other of the lands with the other of the openings formed therein projects downwardly below the remainder of the cover disk.

It has been found to be advantageous to provide the cover disk along and directly adjoining the short wall portion with a narrow annular zone inclined slightly upwardly and inwardly toward the axis.

The upper one of the lands is then formed at a level of an inner edge of the annular zone while the lower land can lie well below the annular zone. The cover disk can then have a main portion inclined downwardly from the upper land and the inner edge and can be connected with this inner edge by a downwardly and inwardly inclined annular transition zone.

While the annular zone can be inclined to a plane normal to the axis at an angle between 0° and 12°, preferably this angle is in the range of 0.5°to 7°. The main portion can be inclined downwardly from a plane normal to the axis by 0.2° to 7°, preferably by 0.5° to 5°.

I can also provide an upwardly bulging bead formed by a corrugation of the cover disk along an inner edge of the annular zone and such that this bead merges into and terminates at the upper land. The bead can have a crest running from an angular region of the other land at a level of an inner boundary of the annular zone or a slightly higher level and rising along opposite sides of the cover disk to the higher level of the upper land.

This bead can widen toward the upper land. The upper land can have flanks which frustoconically diverge downwardly while the lower land can have flanks frustoconically diverging upwardly according to another feature of the invention.

Advantageously, along a line joining the centers of the openings, the cover disk is planar while it is domed convexly or concavely transverse to this line. Alternatively, along this line the cover disk may be transverse to this line and with the domed portions along the line and transverse to the line having different radii of curvature. The curvature along the line may also have different radii.

BRIEF DESCRIPTION OF THE DRAWING

The above objects, features and advantages of my invention will become more readily apparent from the following description, reference being made to the accompanying highly diagrammatic drawing in which.

SPECIFIC DESCRIPTION

Figure 1:
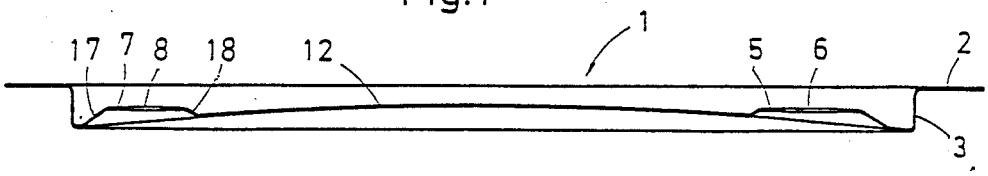
FIG. 1 is a vertical section through a cover of a container according to the invention, the section being taken in a plane along a vertical axis and through the filling opening, it being understood that proper proportioning of the drawing, prevents illustration of wall thicknesses except in detail views.
Figure 2:
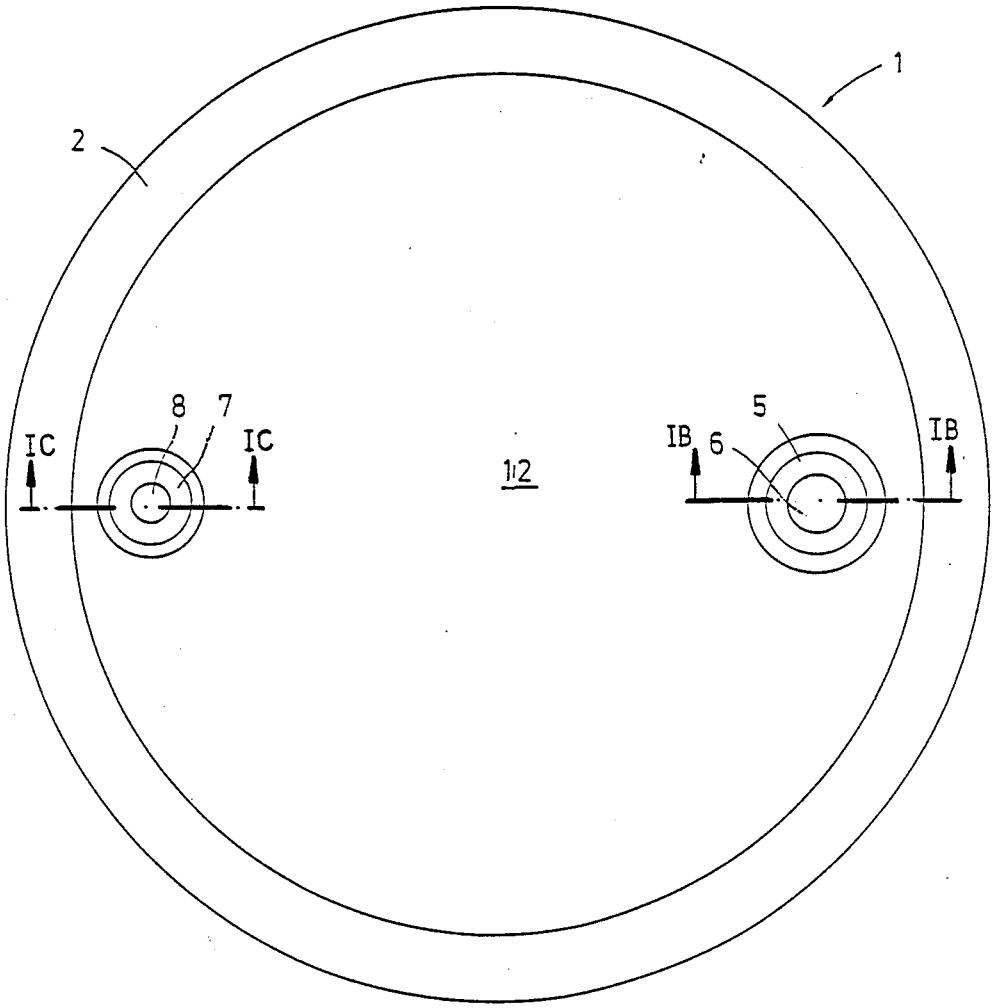
FIG. 2 is a plan view of the cover of FIG. 1.
Figure 1A:
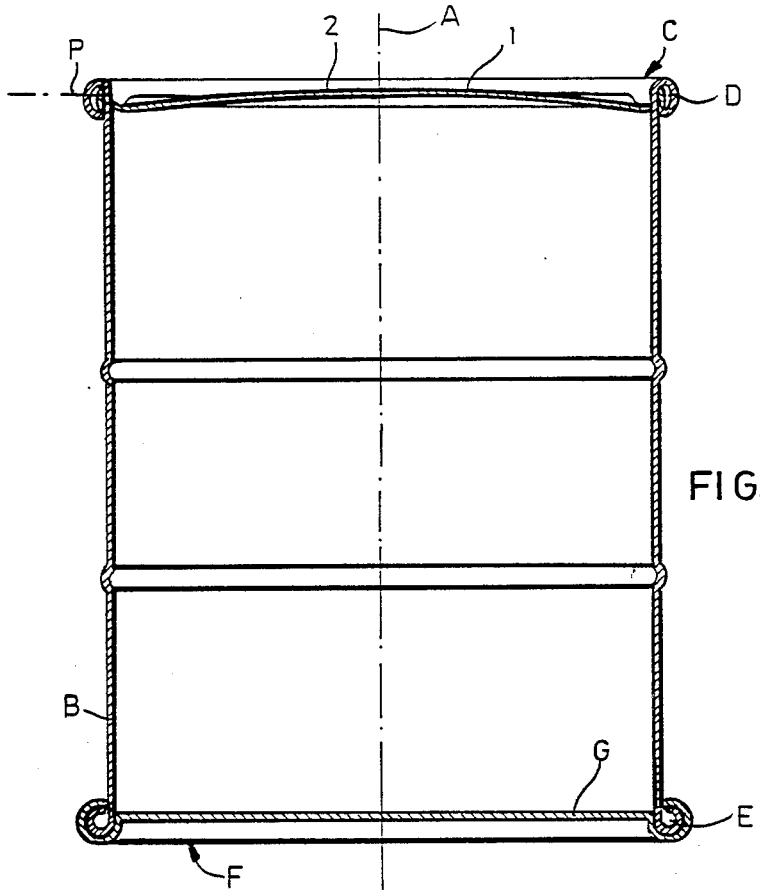
FIG. 1A is a section through a drum provided with the cover of FIG. 1.
Figure 1C:
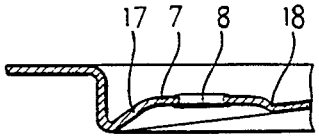
FIG. 1C is a cross-sectional view taken along the line 1C—1C of FIG. 2.

FIG. 1A illustrates in cross section a barrel comprising a generally cylindrical sheetmetal body B having an axis A and formed with opposite ends C and F, respectively, constituting the upper end in an upright position of the barrel.

Within the upper end, a top cover 1 is seated in an upper end of the body B and the lower end is closed by a bottom G, also fitted into the body B by a folded over edge represented at D and E, respectively.

It will be understood that the covers illustrated in the remaining FIGURES all can be used in conjunction with such drums, that the flanges 2 of these covers can form the folded over or inwardly rolled members connecting the covers to the drum body, that the short wall portions 3 will lie against the inner surface of the drum body adjacent the upper edge thereof and the plane P which represents a median plane through the cover disk is a plane normal to the axis A and the lands lie in planes parallel to the plane P and thus also lie normal to the axis A.

From FIGS. 1, 1A, 1B and 1C, it will be apparent that the cover is shown in vertical section in FIGS. 1, 1A, 1B and 1C and comprises a flange 2 which can be connected with the body B of the barrel by folding and/or welding, the flange 2 extending outwardly from a wall portion 3 of limited height and referred to herein as the short wall portion.

The short wall portion 3 thus extends downwardly from the flange 2 and is received with a tight fit within the body so that the upper edge of the body B is reinforced by this short wall portion and, conversely, the wall of the body and, if appropriate, the folded over junction stabilizes the upper end of the barrel.

The short wall portion 3 directly adjoins a cover disk 12 which can have its stability enhanced by a dished disk configuration, the filling openings 6 and 8 being formed in the cover disk 12, preferably along a diameter of this disk and most advantageously by a stamping operation.

The openings 6 and 8 can be provided with bungs, fittings for the attachment of taps, cocks or other closure members or flanged closures.

The two filling openings 6 and 8 may have different diameters. For example, the filling opening 6 may have the larger diameter, for example, two inches and the filling opening 8 the smaller diameter of, for example, three-quarters of an inch.

So that the fittings need not project into the interior of the drum or inwardly beyond the wall of the cover and yet allow the fitting to be welded in place, the filling openings 6 and 8 are provided in lands 5 and 7, respectively, which are thrust upwardly from the dished cover disk 12. The lands 5 and 7 are annular and surround the openings and lie in planes which are normal to the axis.

Figure 1B:
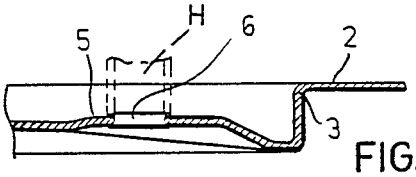
FIG. 1B is a detail cross section taken along the line 1B—1B of FIG. 2.
Figure 4A:
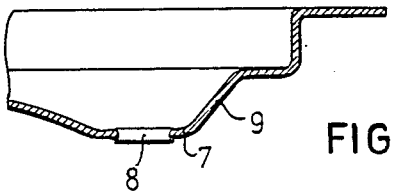
FIG. 4A is a detail of the lower land thereof.

A fitting welded in place has been represented at H in FIG. 1B.

In fabricating the upwardly thrust lands 5 and 7, transition regions 17 are formed which are frustoconical in configuration and widen downwardly (FIG. 1). The generatrices of the frustoconical transition region 17 which lie outwardly are longer than those which lie inwardly, the inner generatrices having been represented at 18 in FIG. 1 of course, with equal length and with different inclinations when the dished disk configuration of the cover disk 12 is used.

While in all cases, it is desirable that the annular lands 5 and 7 lie in planes which are normal, i.e. perpendicular, to the vertical axis of the drum or cover, the configurations of the lands can differ substantially from those that have been shown. For example, the lands may be deeper than the illustration or the opening need not be completely circular. For example, these surfaces may have polygonal or even elliptical configurations without serious detriment and, for example, the transition zones 17 need not be frustoconical but can, for example, be frustoperimetral.

The additional deformation of the cover disk which results in the outwardly thrust lands will be understood to further stabilize and stiffen even a dished disk cover surface 12 so that the resistance of the cover disk 2 deformation is enhanced. In addition, the cold deformation, i.e. the stamping, which is used to produce the lands likewise increases the strength of the material.

An advantage of the present invention, of course, is that after the welding of the fittings in the filling openings, these fittings will be parallel to one another and to the axis. The conical rises forming the lands form funnels when the drum is overturned, to facilitate emptying. Even in the case in which fittings are used which project into the drum, because of the presence of the funnels, the emptying of the drum is improved over systems without the lands.

Figure 3A:
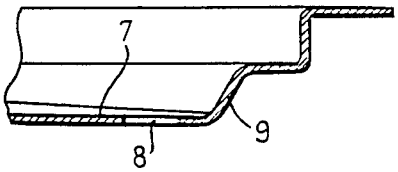
FIG. 3A is a detail of a lower land of the cover of FIG. 3.
Figure 6A:
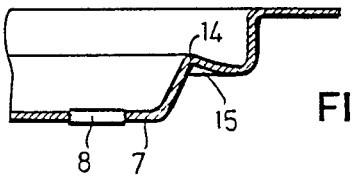
FIG. 6A is a detail section of the lower land region of this cover.
Figure 3:
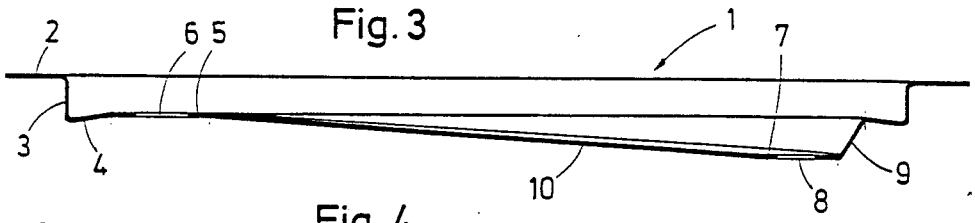
FIG. 3 is a view similar to FIG. 1 of a cover provided with an annular zone as previously mentioned.

FIGS. 3 through 3A illustrate a further cover 1 which can be mounted in a drum body as described. In this embodiment, along the lower end of the short wall portion 3 an annular zone 4 is provided which can be of substantially constant and radial width all around the periphery of the drum so that this annular zone can run within a plane perpendicular to the axis without extending to this axis in a radial direction. Preferably, the annular zone is inclined inwardly and upwardly, i.e. includes an angle of 0° to 12° with a plane normal to the axis and preferably an angle of 0.5° to 7°, most advantageously, no greater than 5°. Unless the drum is invited through 180° for emptying, this annular zone provides a uniform drum to the remainder 10 of the cover disk.

At one side, the annular zone 4 adjoins the land 5 which is substantially horizontal and is provided with and surrounds the filling opening 6. The latter can receive the stub of a bung or tab which can be welded to the cover. The land 5 can lie at the same level as the inner border or edge 15 of the annular zone.

The cover disk surface inwardly of the annular zone 4 and apart from the oppositely raised lands 5 and 7, is inclined downwardly to the plane normal to the axis by at least 0.2°, at most 7° and preferably by between 0.5° and 5°. As a consequence, the deeper portion of the cover disk lies well below the inner edge of the annular zone and between the latter and the remainder of the cover disk 10 a transition zone 9 of a frustoconical configuration is provided.

Where the transition zone 9 disappears into the cover disk 10 at the annular zone 4, the upper horizontal land 5 is formed by pressing it into the cover disk and is formed with the filling opening 6 where the transition zone 9 is most pronounced, the land 7 is formed with the smaller diameter filling opening 8.

Tubular fittings can be welded to the cover 1 for bungs of two inches and three-quarters of an inch in diameter, respectively, as previously described.

The cover can be punched from a sheetmetal blank, stamped, deep drawn or otherwise embossed with the recesses and raised lands.

Figure 5:
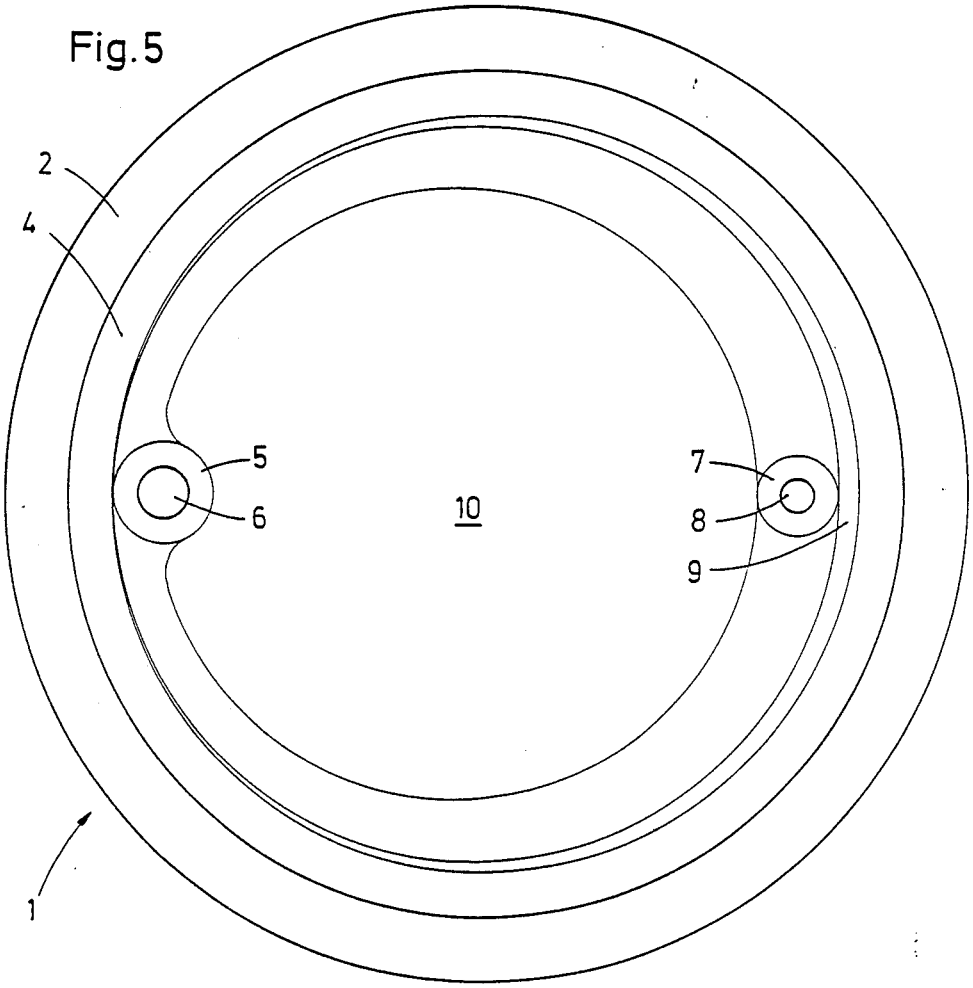
FIG. 5 is a plan view of the cover of FIG. 3.

As can be seen from FIG. 5, the annular zone can surround the cover disk portion 10 and emboss the transition zone 9 between them and have a crescent shape.

The transition zone thus widens to a maximum width at the right-hand or deeper side of the cover and tapers or narrows away from this deeper zone.

In FIG. 1 the stability of the cover is achieved in part by a dished disk configuration to the cover disk.

To allow the most effective emptying, all surfaces of the cover disk should be inclined upwardly toward the raised land or downwardly from the raised land, since the latter will form the lowest point when the drum is inverted.

Figure 4:
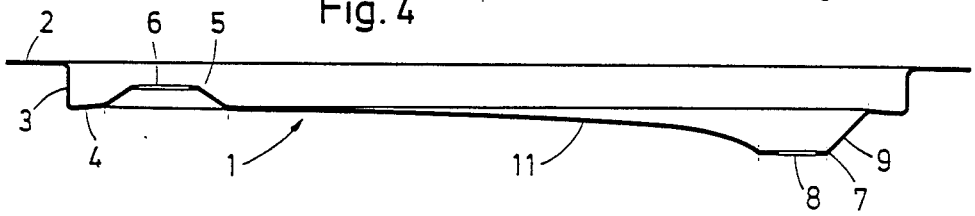
FIG. 4 is another vertical section of a cover having a dished cover disk.

In the embodiment of FIG. 4, the cover disk 11 has a dished disk configuration as contrasted with the configuration of the cover disk 10. The cover disk 10 in FIG. 3 along a straight line connecting the centers of the openings 6 and 8 is planar and the convex or concave curvature is noted in planes transfers to this straight line. In FIG. 4, there is likewise a curvature along this line. The radii of curvature can vary along all the curves so that in general the radius of curvature is not constant across the various domed shapes.

In FIG. 4, for example, the radius of curvature along the line connecting the centers of the holes shortens to the right-hand side of the FIGURE.

Also in the embodiment FIG. 4, as contrasted with that of FIG. 3 is the increasingly raised land 5 with the larger filling operation 6 which lies well above the annular zone 4, in this embodiment as well, the generatrices on opposite sides of the lands can have different lengths.

The configuration of FIG. 4, therefore, ensures that upon inversion of the drum and supporting thereof on the edge of the now inverted cover, all surfaces in the cover are inclined downwardly to the opening 6.

This ensures complete discharges even with liquids of high viscosity simply by permitting the drum to be turned over. Naturally, the second or smaller filling opening likewise can assist in emptying the drum if there is considerable liquid therein, even though the lower land will lie above the upper land in the inverted position of the drum. This has the advantage that during the final draining of allowing air to enter above the traces of liquid in the drum to replace the drained liquid.

The raised and depressed formations described above can easily be fabricated during the shaping of the cover without added expense and can contribute to the strength of the cover as well.

Figure 6:
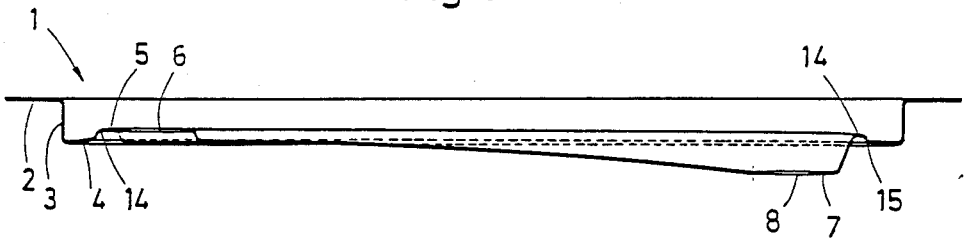
FIG. 6 is a vertical cross-sectional view through a cover having an annular bead as previously described.
Figure 7:
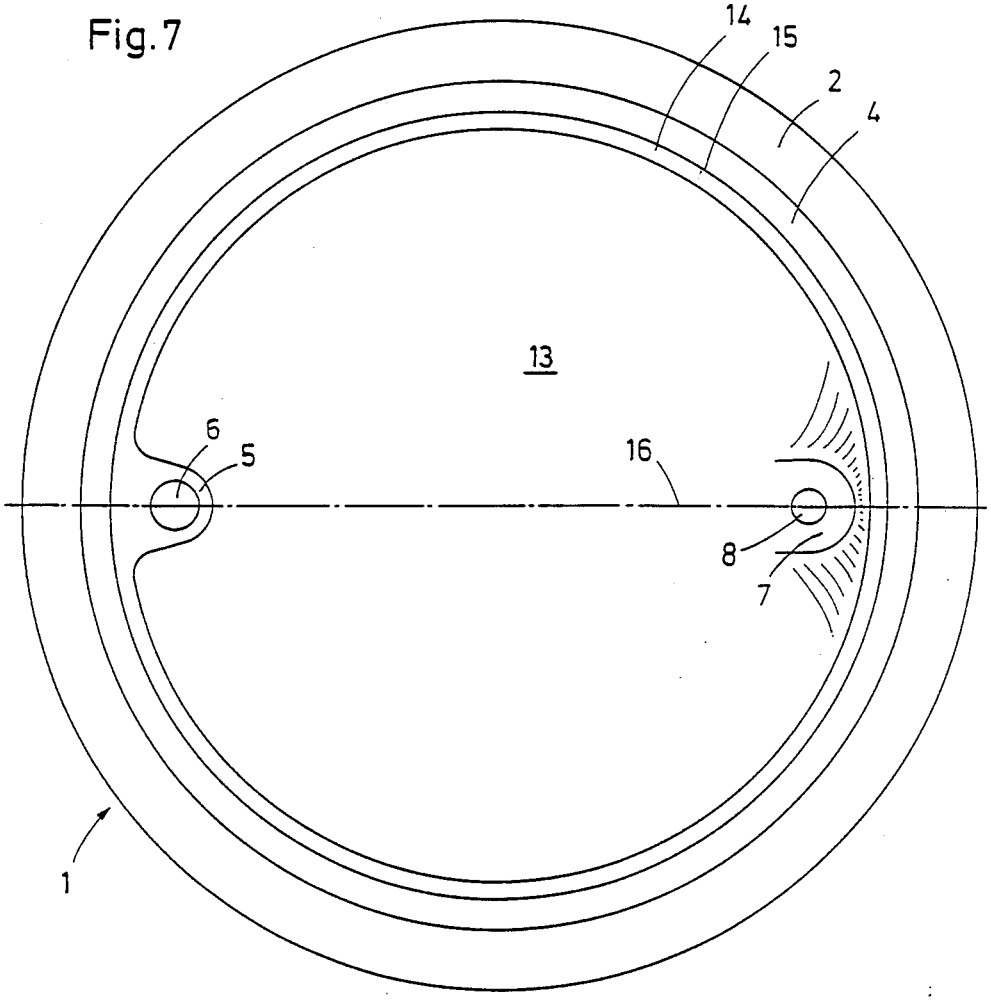
FIG. 7 is a plan view of the cover of FIG. 6.

FIGS. 6 and 7 illustrate another variant in which an annular bead 14 defined by a corrugation in the cover disk 13, is formed between the annular zone 4 and the remainder of the cover disk 13. The bead begins at the right side of the drawing substantially at the level of the inner edge of the annular zone 4 rises with its crests so that the latter can broaden out into the land 5 at the level of the latter. The land 5 has the filling opening 6. In this case, if the drum is inverted to stand on its cover for emptying so as to be free from any residue, any liquid collected in the trough formed by the bead is guided to the deeper part, namely, the point at which the opening 6 is formed to discharge this liquid.

The land 5 also forms, therefore, the lowest part of the cover disk 13 as well so that liquid on this surface likewise flows into the trough or directly to the opening.

The surface 13 can be planar, convex or concave.

Along a line connecting the centers of the openings 6 and 8, the surface can be straight or cylindrically or elliptically domed. In this case, the lines connecting the ends of the lands 5 and 7 can be generatrices.

Of course, a cylindrical doming can be provided with an axis parallel to the line 16 and upon which a second dome-shape is superimposed with an axis perpendicular to the axis 16 but lying in the plane of the paper with additional parallel generatrices.

It is also possible to provide different radii of curvature for the two orthogonal dome shapes or to vary the radius of curvature along either or both of the dome shapes and to make one or the other convex while the other is concave. What is important here, of course, is that all surfaces incline downwardly into the trough and to the land 5 when the drum is inverted.

With this embodiment, whether or not a dished configuration is used, full emptying will be ensured, cleaning of the drum facilitated and maintenance of the drum reduced.

I claim:

1. In a bung-type drum having a generally cylindrical body having opposite ends, a bottom closing a lower end of said body, and a top cover closing an upper end of said body, said cover fitting into said body and having a short wall portion surrounding a cover disk lying transverse to an axis of the body and recessed within said body, said short wall portion lying along an inner surface of said body and having a rim secured to said body at said upper end thereof, said cover disk being formed with at least one filling opening having a bounding edge connectable to a fitting of a closure member, the improvement wherein:

said cover disk is provided with two filling openings;

each of said filling openings is formed in a generally flat land and is surrounded by an annular zone of the respective land;

each of said lands is thrust out of a plane normal to said axis; and at least one of said lands with at least one of said openings formed therein projects above a remainder of said cover disk.

2. The improvement defined in claim 1 wherein the other of said lands with the other of said openings formed therein projects downwardly below the remainder of said cover disk.

3. The improvement defined in claim 2 wherein:

said cover disk is formed along and directly adjoining said short wall portion with a narrow annular zone inclined slightly upwardly and inwardly toward said axis;

said one of said lands is formed at a level of an inner edge of said annular zone and said one of said lands lies in a plane normal to said axis; and said cover disk has a main portion inclined downwardly from said one of said lands and said inner edge and connected with said inner edge by a downwardly and inwardly inclined annular transition zone.

4. The improvement defined in claim 3 wherein said annular zone is inclined to a plane normal to said axis at an angle greater than zero and up to 12°.

5. The improvement defined in claim 4 wherein said angle is in the range of 0.5° to 7°.

6. The improvement defined in claim 3 wherein said main portion is inclined downwardly from a plane normal to said axis by 0.2° to 7°.

7. The improvement defined in claim 6 wherein said main portion is inclined downwardly from a plane normal to said axis by 0.5° to 5°.

8. The improvement defined in claim 2 wherein:

said cover disk is formed along and directly adjoining said short wall portion with a narrow annular zone inclined slightly upwardly and inwardly toward said axis; and said cover disk is further formed with an upwardly bulging bead formed by a corrugation of said cover disk along an inner edge of said annular zone and ending at said one of said lands.

9. The improvement defined in claim 8 wherein said bead has a crest running from an angular region of said other land at the level of an inner boundary of said annular zone or a slightly higher level and rising along opposite sides of the cover disk to the higher level of said one of said lands.

10. The improvement defined in claim 9 wherein said bead widens toward said one of said lands.

11. The improvement defined in claim 2 wherein said other of said lands has flanks which extend frustoconically upwardly toward said remainder of said cover disk.

12. The improvement defined in claim 1 wherein said one of said lands has flanks frustoconically diverging downwardly toward said remainder of said cover disk.

13. The improvement defined in claim 1 wherein along a line joining centers of said openings, said cover disk is generally planar and said cover disk has a domed shape transverse to said line.

14. The improvement defined in claim 13 wherein said domed shape is outwardly convex.

15. The improvement defined in claim 13 wherein said domed shape is outwardly concave.

16. The improvement defined in claim 1 wherein along a line joining centers of said openings, said cover disk has generally domed shape and said cover disk also has a domed shape transverse to said line.

17. The improvement defined in claim 16 wherein the domed shape transverse to said line has a different radius of curvature than the domed shape along said line.

18. The improvement defined in claim 16 wherein the domed shapes are outwardly convex.

19. The improvement defined in claim 16 wherein the domed shapes are outwardly concave.

20. The improvement defined in claim 1 wherein along a line joining centers of said openings, said cover disk has different radii of curvature.

* * * * *